US005771551A

United States Patent [19]

Schurter et al.

[11] Patent Number: 5,771,551

[45] Date of Patent: Jun. 30, 1998

[54] TOOL FOR PUNCHING AND RIVETING INCLUDING A COMBINATION CYLINDER

[75] Inventors: Robert M. Schurter, Colgate; Karl W. Richter, Brookfield; Edward Y. Byaliy, Shorewood, all of Wis.

[73] Assignee: AOS Holding Company, Wilmington, Del.

[21] Appl. No.: 815,039

[22] Filed: Mar. 13, 1997

[51] Int. Cl.[6] ..... B23P 11/00

[52] U.S. Cl. ..... 29/243.54; 59/7; 72/453.19

[58] Field of Search ..... 29/243.54, 243.53; 59/7; 72/453.19, 411, 477

[56] References Cited

U.S. PATENT DOCUMENTS 3,534,456 10/1970 Swartz .
3,613,493 10/1971 Conn et al. .
3,724,738 4/1973 Hurst .
4,369,907 1/1983 Muhr et al. .
4,955,119 9/1990 Bonomi et al. .

*Primary Examiner*—David Jones

[57] ABSTRACT

A combination punch and rivet tool, the tool being adapted to be mounted on the end of a robot arm, the tool comprising a C frame having two opposed sides, a punch die mounted on one side of the C frame, an anvil slidably mounted on said one side adjacent the punch die and selectively movable between a first position away from the punch die and a second position over the punch die, and a combination cylinder mounted on the other side of the C frame opposite the punch die, the combination cylinder comprising a coaxial inner punch and an outer rivet forming tool.

3 Claims, 2 Drawing Sheets

TOOL FOR PUNCHING AND RIVETING INCLUDING A COMBINATION CYLINDER

BACKGROUND OF THE INVENTION

This invention relates generally to the fastening art and more particularly to improvements in tooling attachments useful with robots or other automation devices for the purpose of automating the assembly and integration of parts by means of rivets or similar fasteners.

Under modern day manufacturing technology, computer controlled high speed mobile machining centers or "robots", equipped with one or more drive spindles capable of selected spacial positioning and adapted to receive various machine tools, have gained popular acceptance for carrying out a variety of automatic machining operations.

In certain limited instances, such robots have been adapted to riveting procedures wherein a single robot working over fixture-held work pieces performs the successive functions of hole preparation, rivet insertion and rivet installation at each rivet location before proceeding to the next rivet location. See, for example, Bonomi et al. U.S. Pat. No. 4,955,119.

BRIEF SUMMARY OF INVENTION

This invention provides a combination punch and rivet tool, the tool being adapted to be mounted on the end of a robot arm, the tool comprising a C frame having two opposed sides, a punch die mounted on one side of the C frame, an anvil slidably mounted on said one side adjacent the punch die and selectively movable between a first position away from the punch die and a second position over the punch die, and a combination cylinder mounted on the other side of the C frame opposite the punch die, the combination cylinder comprising a coaxial inner punch and an outer rivet forming tool.

The present invention constitutes an improvement over prior known fastener tooling applications and procedures in that it presents a single end effector attachment which, without adding any additional tools, permits the punching and riveting of two or more metal sheets.

Another important object of this invention is to provide an improved end effector for use with the mobile head of a robot which presents two aligned spaced tool heads, operable on opposite sides of assembly parts.

IN THE DRAWINGS

Having described this invention, the above and further objects, features and advantages thereof will be apparent to those of skill in the art from the following detailed description of a preferred embodiment of the invention illustrated in the accompanying drawings and representing the best mode presently contemplated for enabling those of skill in the art to carry out and practice this invention.

DESCRIPTION OF THE PREFERRED EMBODIMENT

Before describing the details of the improved tool according to this invention, initial consideration will be given to the general characteristics of a preferred working environment in which to practice this invention.

It is to be noted that the illustrative embodiments of this invention described hereinafter are related to the production and assembly of components and parts utilized in the automotive industry in which large, relatively heavy structures of relatively complex shape, such as frame sections, are involved. Those familiar with this art, however, will readily recognize other fields of use and application for this invention.

In general, an end effector or tool 10 according to this invention is best used in a work cell environment in which one or more computer controlled robotic machining centers, or robots, capable of imparting multi-axis linear and rotational movements to the end effector hereof, may be employed. In some circumstances, however, the tool 10 is either mounted (not shown) in a position where work pieces are brought to the tool 10, or the tool 10 is suspended by a cable (not shown) and moved by an operator.

Figure 1:
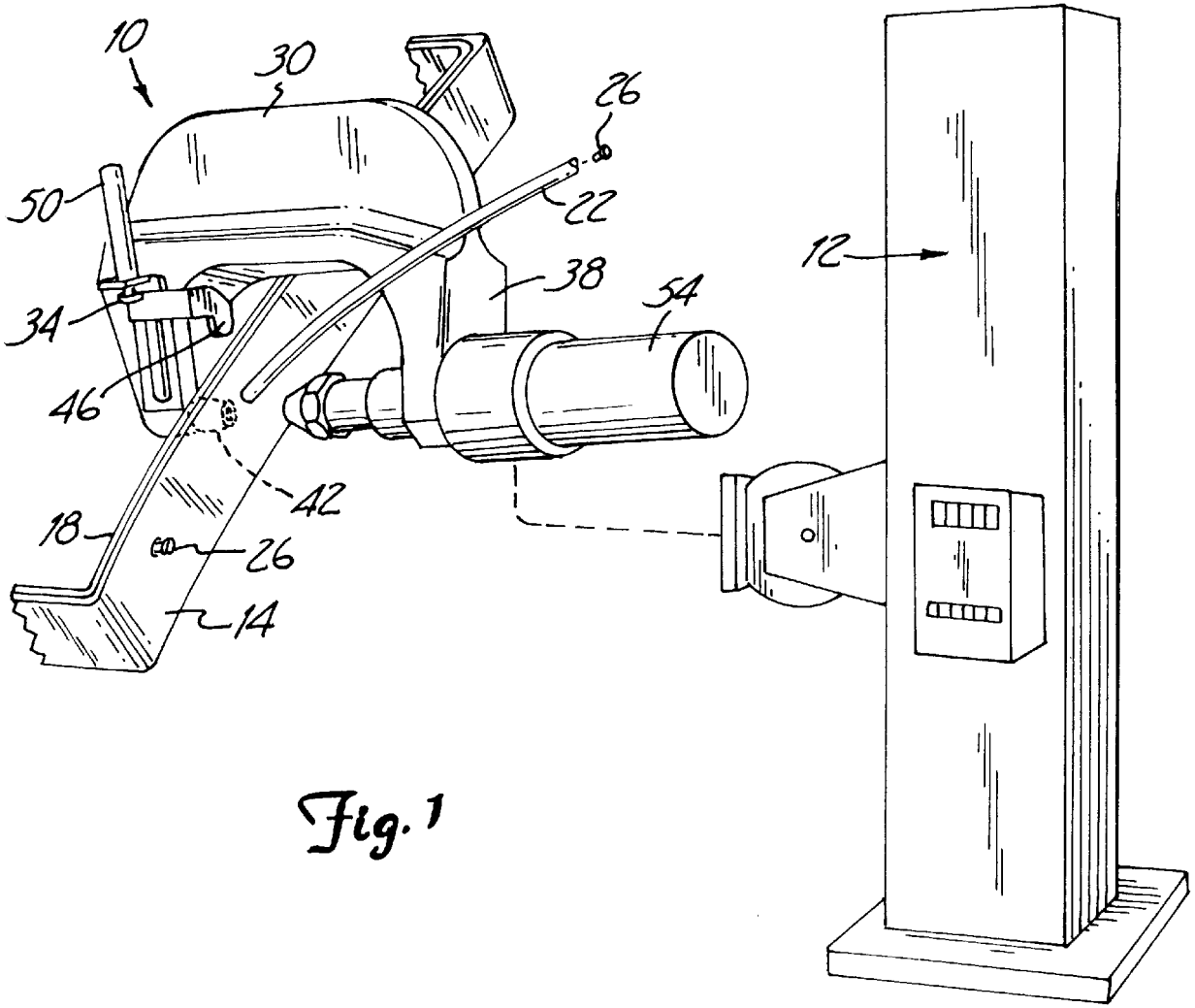
FIG. 1 is a schematic representation of a work cell and robot equipped with an end effector according to this invention.

Typifying a robotic environment is the work cell illustrated in FIG. 1 of the drawings which comprises a high speed machining center or robot designated 12 mounted to move along a pair of parallel elongated horizontal tracks or railways (not shown) in response to actuation of power driven rack and pinion drive means or the like (not shown). The illustrated robot 12 is of Cartesian structure having linear, horizontal, vertical and transverse X, Y and Z axes of movement. In other embodiments, a stationary robot may be used.

Robotic machine tool centers capable of carrying out the above and other tasks required by this invention are commercially available, so long as the selected robot is of rigid construction and has a capability of high accuracy in positioning the working tools. Regardless of the particular robot selected it is essential that the same provide a rigid support for the end effector of this invention, as well as the appropriate pneumatic, hydraulic and electrical power supplies necessary for driving the tooling carried by the end effector for the purpose of installing fasteners or performing other operations in the fixture held assembly parts.

Located opposite the robot 12 is an adjustable fixture (not shown) for holding the assembly of parts and components, such as two frame panels, 14 and 18, respectively, (see FIG. 1). The robot 12 is also equipped with a rivet feed system 22. It is shown schematically as a feed tube into which rivets 26 may be placed, the feed tube directing the rivets to the hole which has been punched by the end effector 10. Turning now to the features of the illustrated preferred embodiment of the present invention, specific reference is made to FIGS. 1–4 of the drawings.

The C frame or yoke 30, as illustrated in FIG. 1, comprises a substantially inverted U- or C-shaped support member or frame formed preferably as a rigid fabricated or cast structure of light weight material, such as aluminum or magnesium steel. It is to be understood that while the yoke 30 is herein illustrated to be of generally symmetrical configuration, the particular shape of the yoke may be widely varied and custom fit to dedicate it to the shape of a particular assembly encountered by the tool 10. For example, the throat of the illustrated yoke 30 can be considerably elongated from that illustrated to accommodate positioning of the tool 10 over a greater work area of the assembled parts. In a like manner, the C configuration may be asymmetrical with the downwardly extending arms of the C being curved, inclined or custom shaped to accommodate the particular shape of the parts assembly. Other configurations will be apparent to those with skill in this art.

More particularly, the yoke or C-frame 30 has two opposed sides, 34 and 38, respectively, a punch die 42 mounted on side 34 of the C frame, and an anvil 46 slidably mounted adjacent the punch die 42 and selectively movable by a solenoid 50 between a first position (see FIG. 1) away from the punch die 42 and a second position (see FIG. 4) over the punch die 42.

Figure 2:
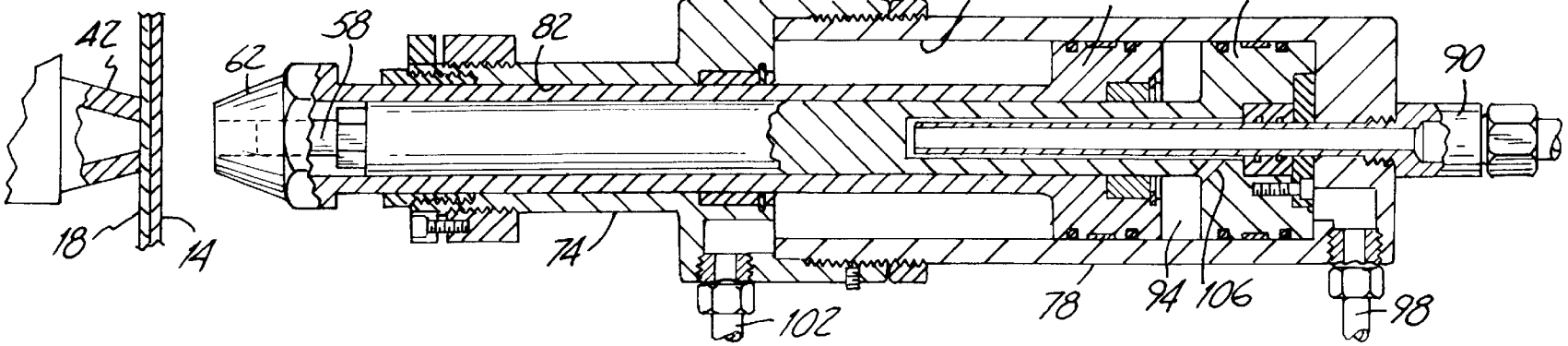
FIGS. 2–4 are partial elevations schematically depicting successive steps of installing a rivet with the end effector hereof.
Figure 4:
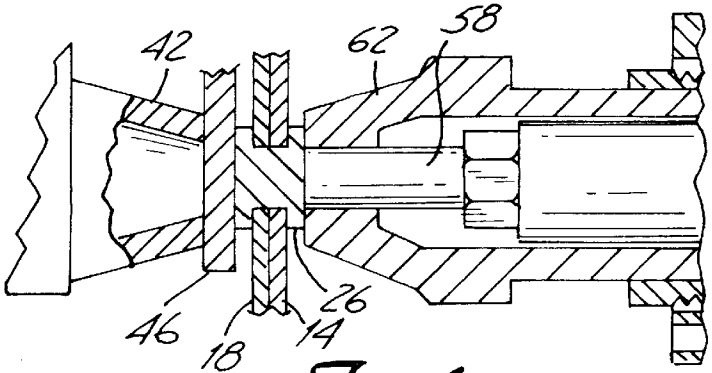
Figure 3:
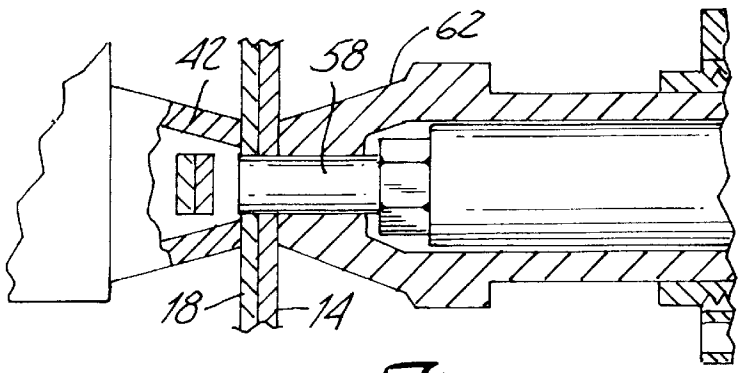

The tool 10 further includes a combination cylinder 54 mounted on the other side 38 of the C frame 30 opposite the punch die 42, the combination cylinder 54, as shown in FIG. 2, comprising a coaxial inner punch 58 and an outer rivet forming tool 62. Each of the punch 58 and the rivet forming tool 62 include a hydraulic piston 66 and 70, respectively.

The combination cylinder 54 includes a forward portion 74 and a rearward portion 78. The forward portion 74 includes a bore 82 which receives the coaxial punch 58 and the rivet forming tool 62. The rearward portion 78 is threaded into the forward portion 74 and houses in a larger bore 86 the rivet tool piston 70 which drives the rivet forming tool 62 and the punch piston 66 which drives the punch 58.

The combination cylinder 54 further includes means for moving the pistons 66 and 70. More particularly, the combination cylinder 54 includes a rearward port 90 adapted to supply hydraulic fluid from an outside source (not shown) into and out of a space 94 between the punch piston 66 and the rivet tool piston 70. Means is also provided for driving the punch piston 66 which moves both the punch 58 and the rivet forming tool 62, this means including an inlet 98 which supplies hydraulic fluid to the punch piston 66, and a fluid outlet 102 in the combination cylinder forward portion 74. In the embodiment, the punch 58 constitutes an inner rod located within the outer rivet forming tool cylinder 62. The punch piston 66 further includes an inner passageway 106 for providing hydraulic fluid through the punch piston 66 and into the space 94 between the punch piston 66 and the rivet tool piston 70.

In operation the rivet forming tool 62 and punch 58 are driven toward the punch die 42 by supplying hydraulic fluid through the inlet 98 to the back side of the punch piston 66. The fluid between the rivet forming tool piston 70 and the punch piston 66 in the space 94 causes the rivet forming tool 62 to move down with the punch 58 so that the work piece is clamped between the combination cylinder 54 and the punch die 42. Fluid is then supplied through the inlet 98 and withdrawn from the space 94 between the pistons, thereby driving the punch through the work piece (see FIG. 3). Thereafter, fluid is supplied into the space 94 between the punch piston and the rivet forming cylinder thereby withdrawing the punch to the point where the face of the punch is even with the face of the rivet forming tool. Next the rivet tool 62 and punch 58 are withdrawn and a rivet 26 is placed in the hole made by the punch 58. Fluid is then again supplied to the back side of the punch piston 66 and the two pistons again are driven down so that the rivet 26 is now flattened (see FIG. 4) between the face of the punch and rivet forming tool 62 and the anvil 46, which had been moved over the opening in the punch die 42. In this manner a hole is punched in the work piece and then a rivet is supplied to the work piece and fastened to the work piece.

Various features of this invention are set forth in the following claims.

We claim:

1. A combination punch and rivet tool comprising a C frame having two opposed sides, a punch die mounted on one side of the C frame, an anvil slidably mounted on said one side adjacent the punch die and selectively movable between a first position away from the punch die and a second position over the punch die, and a combination cylinder mounted on the other side of the C frame opposite the punch die, the combination cylinder comprising a coaxial inner punch and an outer rivet forming tool.

2. A tool in accordance with claim 1 wherein said tool further includes means for supplying rivets to a hole in a workpiece formed by the punch.

3. A combination punch and rivet tool, the tool being adapted to be mounted on the end of a robot arm, the tool comprising a C frame having two opposed side, a punch die mounted on one side of the C frame, an anvil slidably mounted on said one side adjacent the punch die and selectively movable between a first position away from the punch die and a second position over the punch die, and a combination cylinder mounted on the other side of the C frame opposite the punch die, the combination cylinder comprising a coaxial inner punch and an outer rivet forming tool.

* * * * *